US006907916B2

(12) United States Patent
Koyama

(10) Patent No.: US 6,907,916 B2
(45) Date of Patent: Jun. 21, 2005

(54) COOLING APPARATUS FOR A WORK MACHINE

(75) Inventor: Hitoshi Koyama, Hirakata (JP)

(73) Assignee: Komatsu Ltd., Tokyo (JP)

( * ) Notice: Subject to any disclaimer, the term of this patent is extended or adjusted under 35 U.S.C. 154(b) by 8 days.

(21) Appl. No.: 10/278,857

(22) Filed: Oct. 24, 2002

(65) Prior Publication Data

US 2003/0085027 A1 May 8, 2003

(30) Foreign Application Priority Data

Nov. 5, 2001 (JP) ..... 2001-338997

(51) Int. Cl.[7] ..... F28F 9/00
(52) U.S. Cl. ..... 165/67; 165/140; 180/68.4
(58) Field of Search ..... 165/67, 68.4, 120, 165/121, 122, 140

(56) References Cited

U.S. PATENT DOCUMENTS 2,505,790 A * 5/1950 Panthofer ..... 165/140
4,131,156 A 12/1978 Crumrine et al.
4,137,982 A * 2/1979 Crews et al. ..... 180/68.4
4,651,816 A * 3/1987 Struss et al. ..... 165/76
5,046,554 A * 9/1991 Iwasaki et al. ..... 165/140
5,095,882 A * 3/1992 Christensen ..... 123/563
5,234,051 A * 8/1993 Weizenburger et al. ..... 165/41
5,623,893 A 4/1997 Bartz et al.
6,044,810 A 4/2000 Surridge
6,298,906 B1 10/2001 Vize
6,622,783 B2 * 9/2003 Hitt et al. ..... 165/121
6,817,404 B2 * 11/2004 Frana-Guthrie et al. ..... 165/43

FOREIGN PATENT DOCUMENTS

JP 62175218 7/1987
JP 11123940 11/1999
JP 11350530 12/1999

* cited by examiner

*Primary Examiner*—Allen J. Flanigan
(74) *Attorney, Agent, or Firm*—Varndell & Varndell, PLLC

(57) ABSTRACT

A cooling apparatus of a work machine which facilitates maintenance such as cleaning, check and remedy of cooling equipments such as a radiator, an oil cooler and an after cooler is provided. A frame which forms an opening portion on a ventilation passage is provided on an upper stream side of a fan, and a radiator and an oil cooler or a radiator and an oil cooler and an after cooler are arranged in parallel at the opening portion of the frame. At least one of the radiator and the oil cooler or at least one of the radiator and the oil cooler and the after cooler is mounted to the frame detachably. A fan shroud is mounted to the frame. A part of the fan shroud may be detachable.

8 Claims, 9 Drawing Sheets

COOLING APPARATUS FOR A WORK MACHINE

BACKGROUND OF THE INVENTION

1. Field of the Invention

The present invention relates to a cooling apparatus for a work machine.

2. Description of the Related Art

A radiator for radiating a heat of cooling water of an engine, and an oil cooler for radiating a heat of hydraulic fluid of a hydraulic equipment are necessary for a work machine. Further, in recent years, in order to heighten an intake air efficiency of an engine so as to heighten an engine performance, an after cooler for cooling a compressed supercharged air is adopted. Some techniques, which arrange such cooling equipments so as to heighten a cooling efficiency and take a maintainability and compactness of an installation space into consideration, have been conventionally suggested.

The first example is a cooling apparatus of a work machine disclosed in Japanese Patent Application Laid-Open No. H11-350530 (1999), and FIG. 7 is an arrangement diagram of the cooling apparatus described in this publication. In FIG. 7, a radiator 33 is arranged on a front surface of a fan 32 driven by an engine 31 in the cooling apparatus 30, and an oil cooler 34 and an intercooler 35 are arranged in parallel on the front surface of the radiator 33. A ventilation area and a thickness of the oil cooler 34 are determined so that a thickness in a ventilation direction becomes approximately uniform. Here, a capacitor 36 for an air conditioner is provided in front of the intercooler 35.

The second example is a cooling apparatus for a motorcar disclosed in Japanese Unexamined Utility Model Publication No. S62-175218 (1987). FIG. 8 is a front view and a partially cross sectional view of the cooling apparatus disclosed in this publication. In FIG. 8, an upper tank 41 and a lower tank 42 are provided on an upper portion and a lower portion of the cooling apparatus 40, respectively. The upper tank 41 and the lower tank 42 are partitioned by partition plates 43 and 44 into two right and left upper tanks 45 and 46 and two lower tanks 47 and 48. The upper tank 45 and the lower tank 47 are connected by a radiation tube 49 so as to form a radiator 50. The upper tank 46 and the lower tank 48 are connected by a radiation tube 51 so as to form an intercooler 52. Side supports 53 are fixed to both side portions of the cooling apparatus 40 where the radiator 50 and the intercooler 52 are integral, respectively. The cooling apparatus 40 is mounted to a body frame, not shown, via the side supports 53. In such a manner, the radiator 50 and the intercooler 52 are arranged so that their front surfaces are approximately flush with each other, thereby improving cooling efficiency of the radiator 50 and miniaturizing the cooling apparatus 40.

Further, the third example is a cooling apparatus shown in FIG. 9. In FIG. 9, a radiator 63 is provided in front of a fan 62 driven by an engine 61. A coil cooler 64 is provided in front of the radiator 63, and its lower end portion is axially supported by a pin 65 so as to be rotative and its side surface is mounted to the radiator 63 by a bolt 66. When the bolt 66 is loosened, the oil cooler 64 is tiltable forward about the pin 65 up to a position shown by an alternate long and two short dashes line in the drawing. In such a manner, the oil cooler 64 is tilted and an opening width C between the oil cooler 64 and the radiator 63 is widened so that cleaning of the radiator 63 and the oil cooler 64 is facilitated.

However, the above conventional techniques have the following problems.

In the first example, since the oil cooler 34 and the intercooler 35 are arranged in parallel on the front surface of the radiator 33, when dirt and dust which adhere to the front surface of the radiator 33 are cleaned, the oil cooler 34 and the intercooler 35 should be removed. For this reason, the work is troublesome and takes a lot of time.

In the second example, since the radiator 50 and the intercooler 52 are integral, in the case where only one of them is desired to be removed and maintained, both of them should be removed. It is useless.

In the third example, since the oil cooler 64 is tiltable forward, the front upper portion of the radiator 63 can be cleaned, but a cleaning tool is difficulty put to the front lower portion, and thus sufficient cleaning is difficult. Moreover, this problem can be solved by increasing the tilting amount, but this is difficult due to restriction in a space of a car body.

SUMMARY OF THE INVENTION

The present invention pays attention to the above conventional problems, and it is an object of the present invention to provide a cooling apparatus of a work machine which is capable of easily carrying out maintenance such as cleaning, check and remedy of respective cooling equipments such as a radiator, an oil cooler and an after cooler.

In order to achieve the above object, a cooling apparatus of a work machine according to one aspect of the present invention is characterized in that a frame which forms an opening portion on a ventilation passage is provided on an upper stream side of a fan, a radiator and an oil cooler are arranged in parallel at the opening portion of the frame, and at least one of the radiator and the oil cooler is mounted detachably to the frame.

In addition, a cooling apparatus of a work machine according to another aspect is constituted so that a frame which forms an opening portion on a ventilation passage is provided on an upper stream side of a fan, a radiator and an oil cooler and an after cooler are arranged in parallel at the opening portion of the frame, and at least one of the radiator, the oil cooler and the after cooler is mounted detachably to the frame.

According to the above two aspects, since the frame which forms the opening portion on the ventilation passage is provided on the upper stream side of the fan and the radiator and the oil cooler or the radiator and the oil cooler and the after cooler are arranged in parallel at the opening portion of the frame, another cooling equipments do not exist on the front or rear sides of the respective cooling equipments. For this reason, the respective cooling equipments can be removed individually without removing another cooling equipments. Simultaneously, ventilation resistances of the respective cooling equipments are reduced so that a ventilation amount can be increased, and a temperature of cooling wind on the upper stream side of the cooling equipments is lowered, thereby improving cooling efficiency. Moreover, since at least one of the cooling equipments is mounted detachably, it can be removed easily. Therefore, maintenance such as cleaning and check can be carried out easily.

In still another aspect, a fan shroud is mounted to the frame.

According to the still another aspect, since the fan shroud is mounted to the frame, the cooling equipments can be attached/detached without removing the fan shroud, thereby carrying out the maintenance such as cleaning and remedy of the cooling equipments easily.

In still another aspect, a part of the fan shroud is detachable.

According to the still another aspect, since a part of the fan shroud is detachable, only a part of the fan shroud is removed, thereby attaching/detaching the cooling equipments easily. At the same time, dirt and dust which remain inside the fan shroud can be discharged easily, and thus maintainability is very good.

DETAILED DESCRIPTION OF THE INVENTION

There will be explained below a cooling apparatus of a work machine according to embodiments of the present invention referring to FIGS. 1 through 6.

Figure 1:
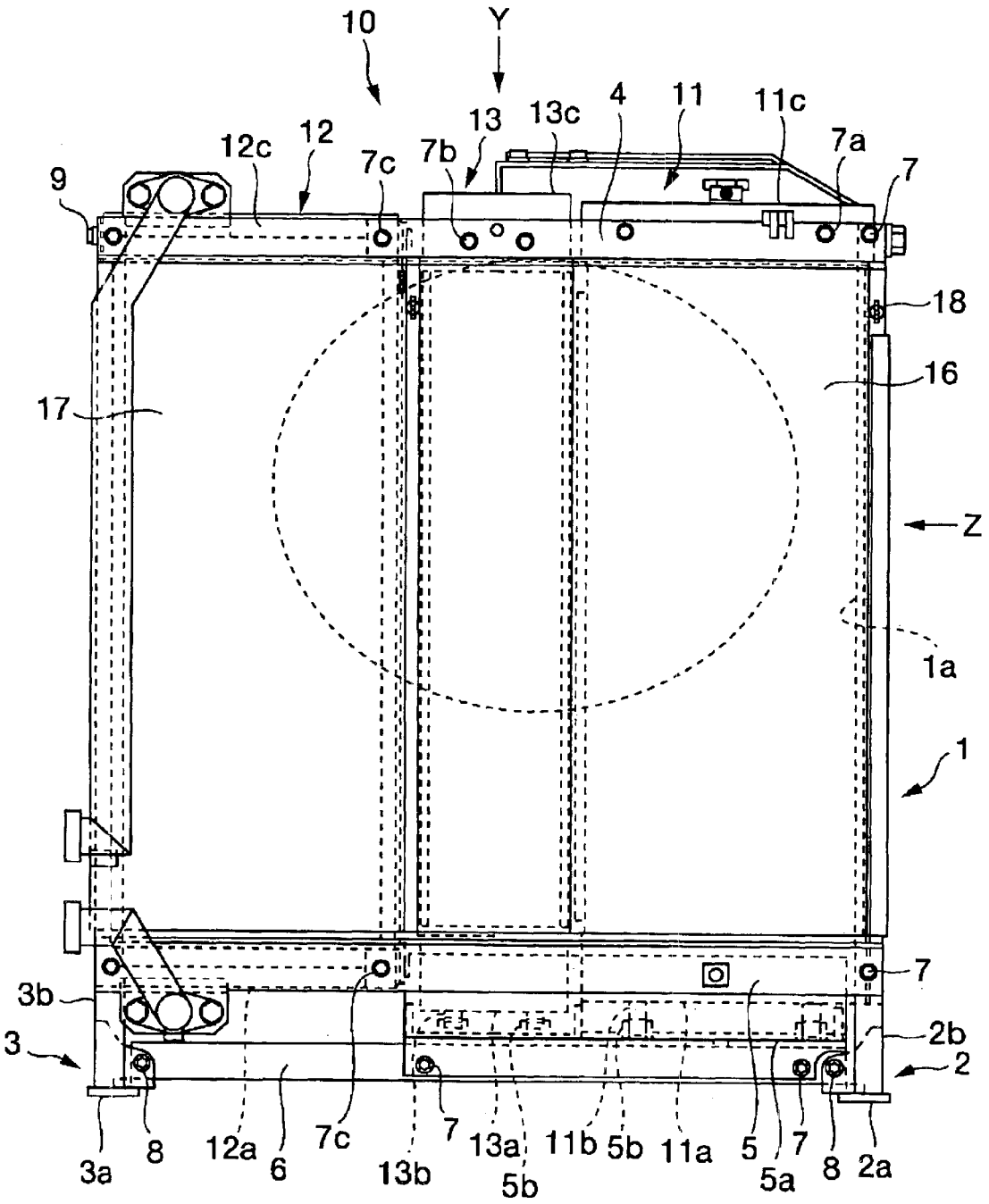
FIG. 1 is a front view of a cooling apparatus according to a first embodiment of the present invention.
Figure 2:
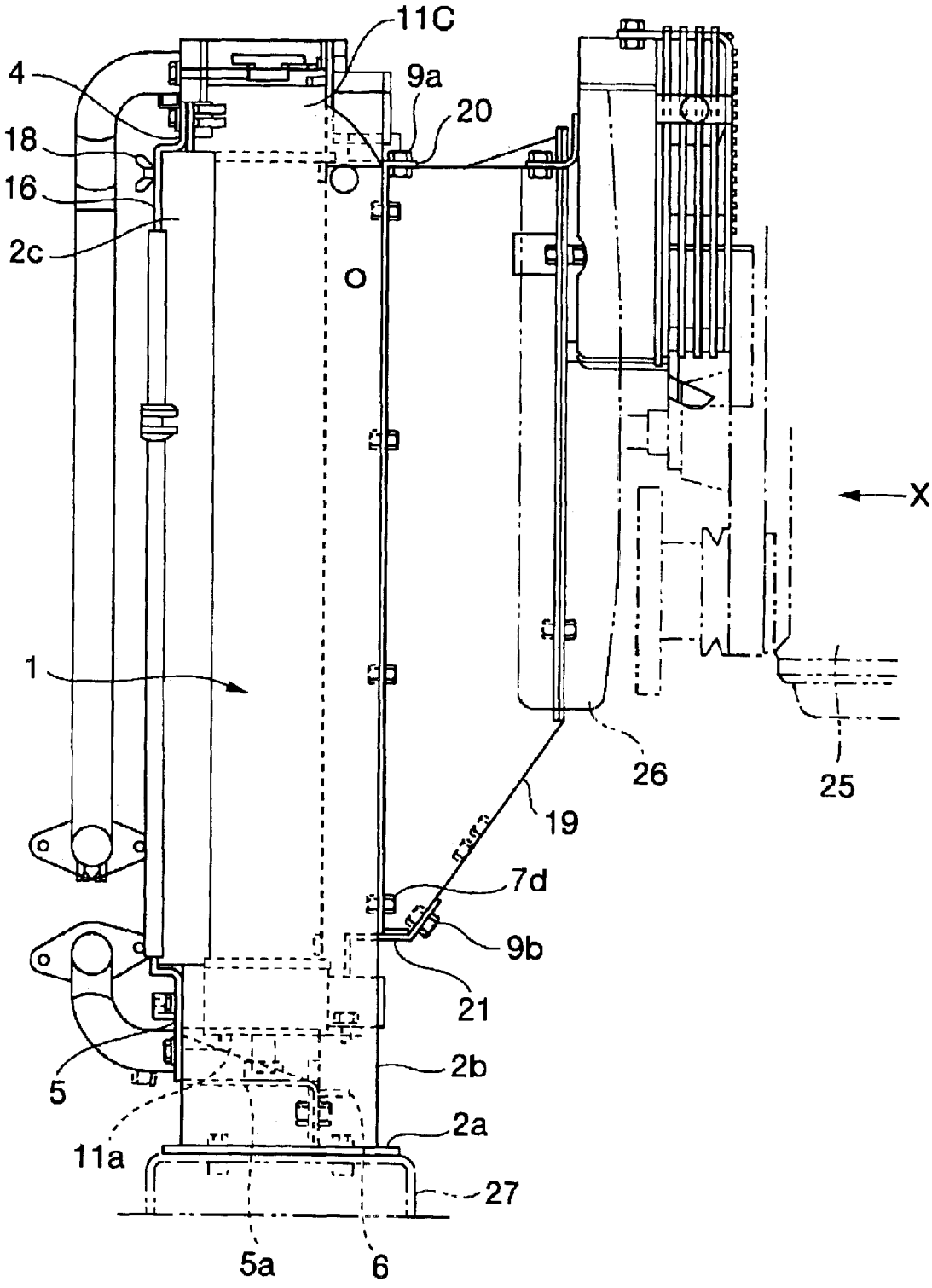
FIG. 2 is a Z view of FIG. 1.
Figure 3:
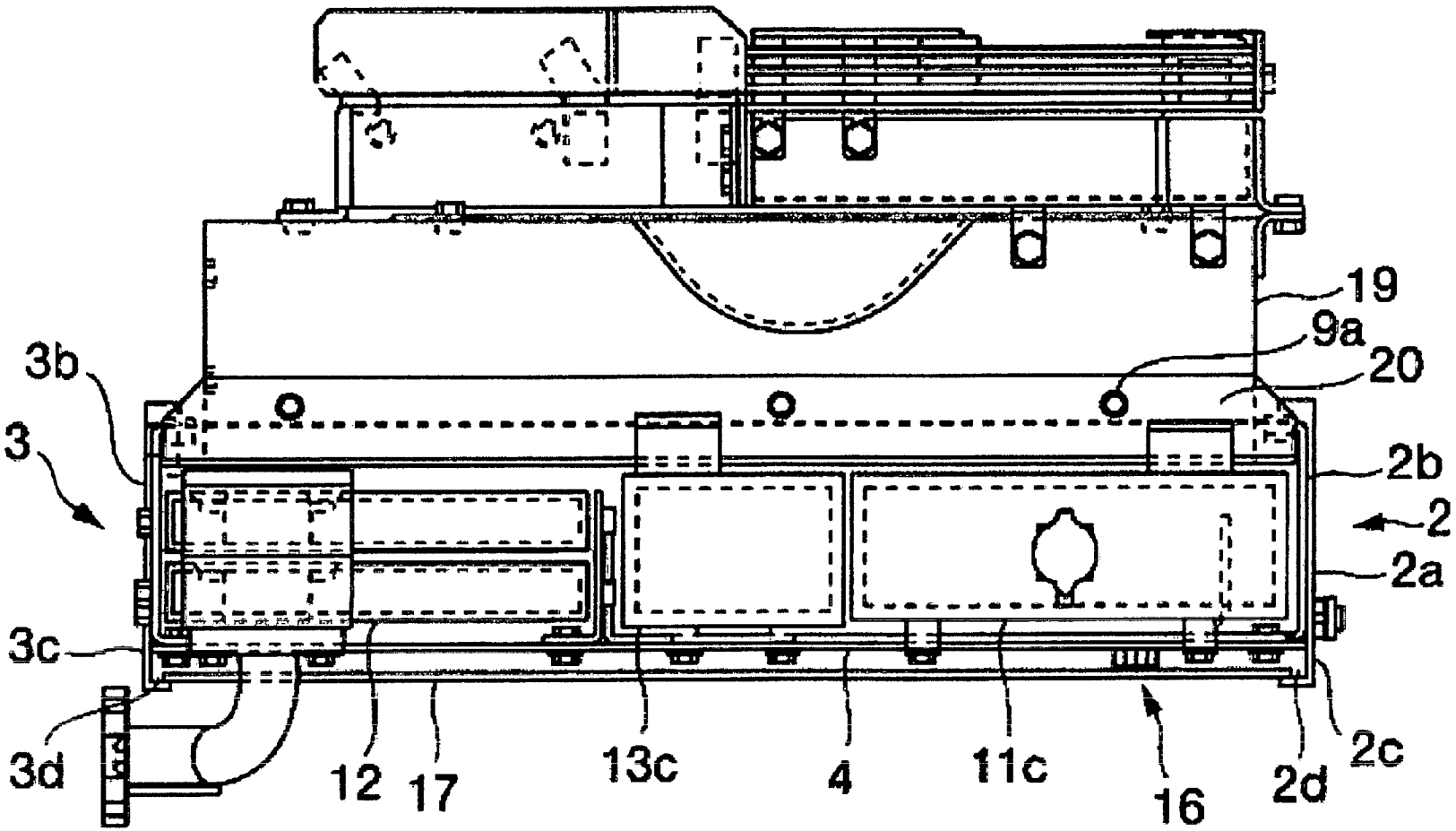
FIG. 3 is a Y view of FIG. 1.
Figure 4:
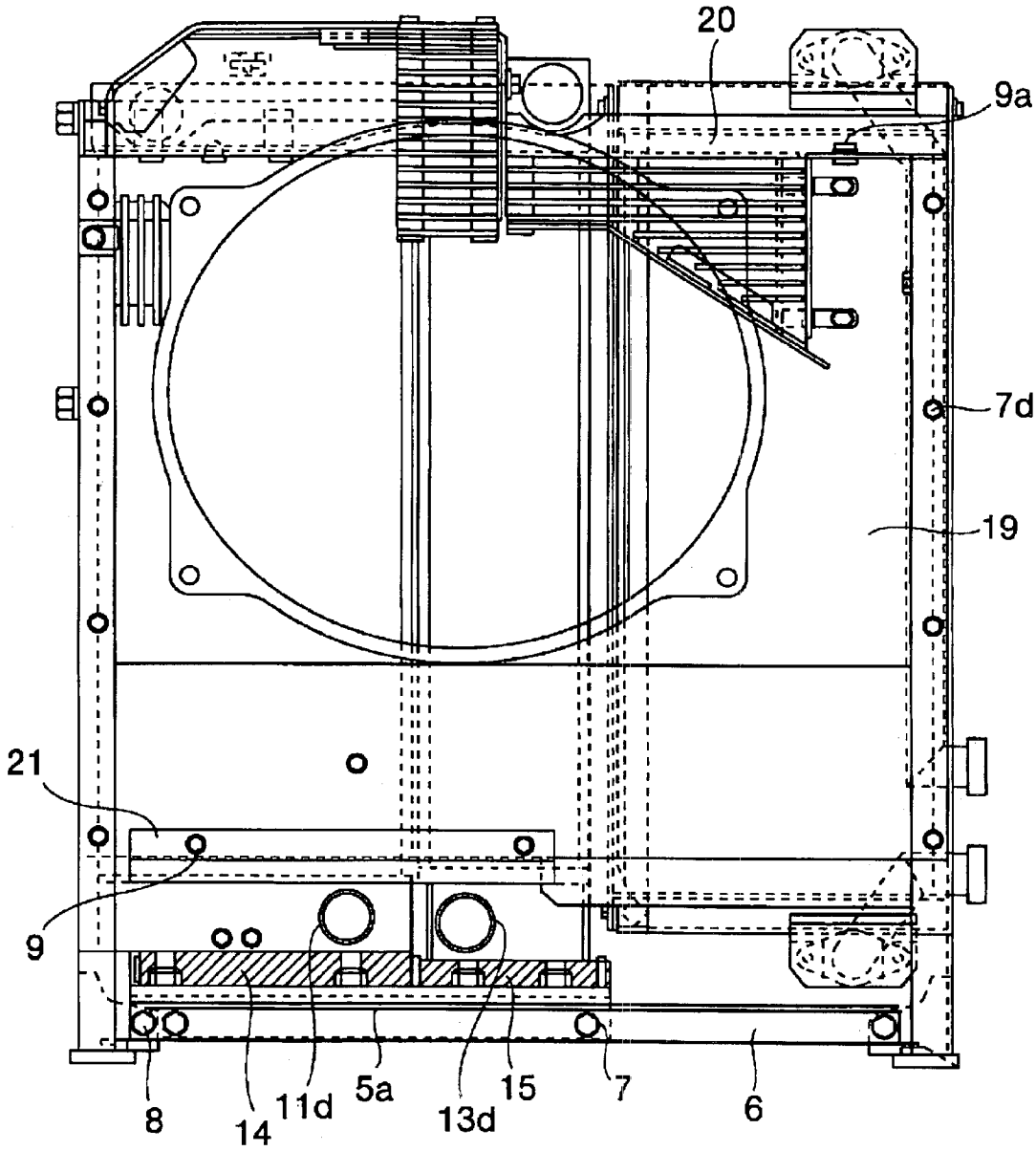
FIG. 4 is a X view of FIG. 2.
Figure 5:
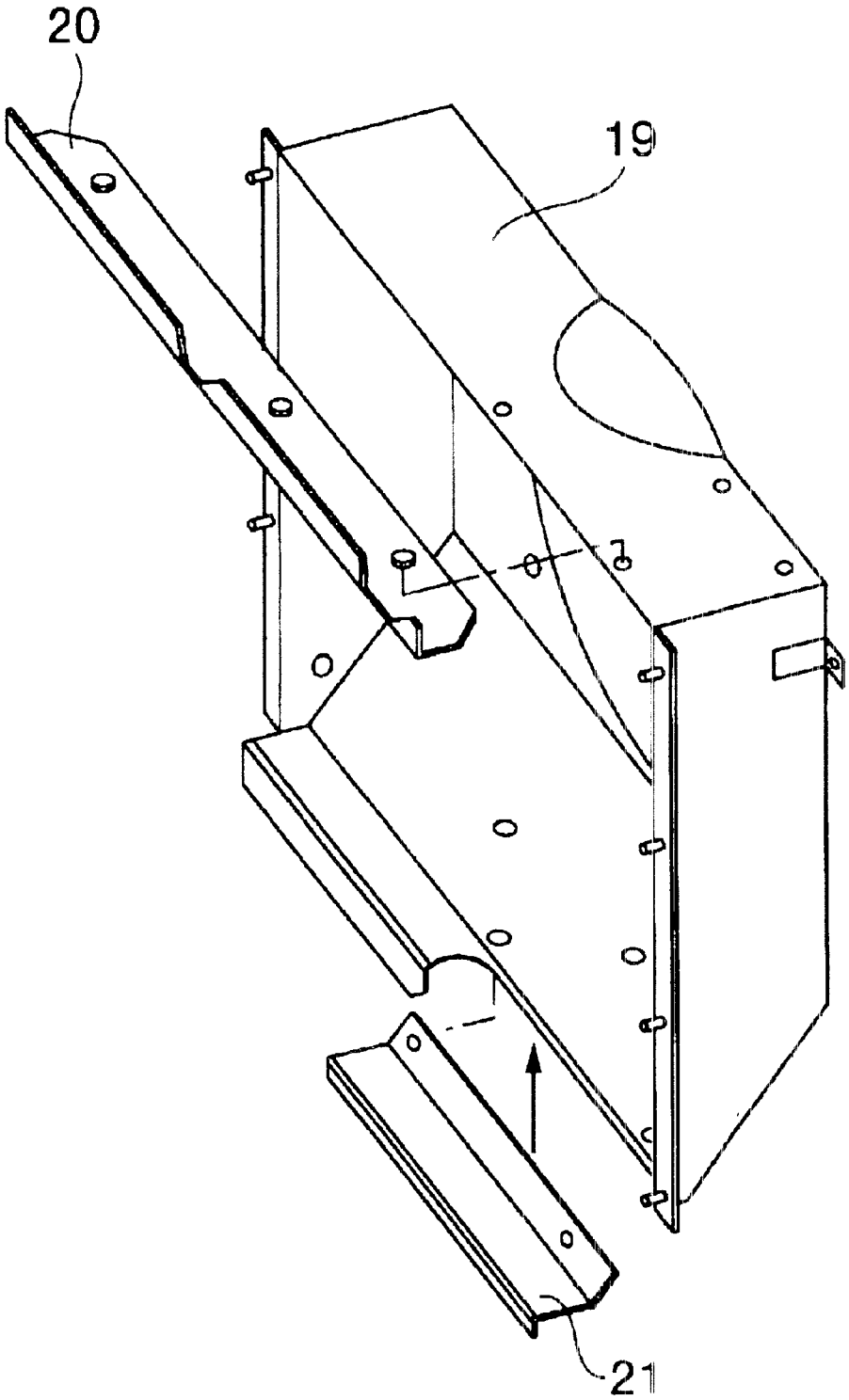
FIG. 5 is a perspective view of a fan shroud.

Firstly, the first embodiment will be explained referring to FIGS. 1 through 5. FIG. 1 is a front view of a cooling apparatus according to the first embodiment, FIG. 2 is a Z view of FIG. 1, and FIG. 3 is a Y view of FIG. 1. Moreover, FIG. 4 is an X view of FIG. 2 and FIG. 5 is a perspective view of a fan shroud.

As shown in FIGS. 1 through 4, in the cooling apparatus 10, a frame 1 which forms an opening portion la on a ventilation passage of a fan 26, is provided on an upper stream side of the fan 26 attached to an engine 25. A radiator 11, an oil cooler 12 and an after cooler 13 are arranged in parallel at the opening portion la of the frame 1 so that their front surfaces are approximately flush with one another.

The frame 1 has left and right frames 2 and 3 which stand on a body frame 27 and upper and lower brackets 4 and 5 which connect the left and right frames 2 and 3 from an up-down direction. The opening portion 1*a* is formed at a center portion by the left and right frames 2 and 3 and the upper and lower brackets 4 and 5.

Namely, bottom plates 2*a* and 3*a* are provided to lower portions of the left and right frames 2 and 3, respectively, so as to be approximately horizontal with each other, and U-shaped vertical plates 2*b* and 3*b* stand on the upper surfaces of the bottom plates 2*a* and 3*a*, respectively. Moreover, the upper and lower brackets 4 and 5 are mounted to front surfaces of the vertical plates 2*b* and 3*b* of the left and right frames 2 and 3, respectively, by bolts 7. The lower bracket 5 is provided with a plate 5*a* approximately horizontally, and four receiving bosses 5*b* which support the radiator 11 and the after cooler 13 are provided on the upper surface of the plate 5*a*. A lower end portion of the backward end side of the plate 5*a* is fixed by bolts 7 to a bracket 6 which is mounted to insides of the vertical plates 2*b* and 3*b* of the left and right frames 2 and 3 by bolts 8.

The radiator 11 has an upper tank 11*c* and a lower tank 11*a* at its up and down portions. Two feet 11*b* which are provided to a lower surface of the lower tank 11*a* are inserted into the receiving bosses 5*b* of the plate 5*a* of the lower bracket 5, and the upper tank 11*c* is fixed to the upper bracket 4 by a bolt 7*a*. In such a manner, the radiator 11 is mounted to the frame 1.

Similarly the after cooler 13 has an upper tank 13*c* and a lower tank 13*a*. Two feet 13*b* which are provided to a lower surface of the lower tank 13*a* are inserted into the receiving bosses 5*b* of the lower bracket 5, and the upper tank 13*c* is fixed to the upper bracket 4 by a bolt 7*b*. In such a manner the after cooler 13 is mounted to the frame 1.

Here, cushions 14 and 15 are inserted among the lower surface of the lower tank 11*a* of the radiator 11 and the lower surface of the lower tank 13*a* of the after cooler 13 and the plate 5*a* of the lower bracket 5.

The oil cooler 12 is mounted to the frame 1 in such a manner that its front portion is fixed to the upper and lower brackets 4 and 5 by a bolt 7*c* and its side portion is fixed to an inner surface of the vertical plate 3*b* of the right frame 3 by a bolt 9.

In addition, dustproof nets 16 (for the radiator 11 and the after cooler 13) and 17 (for oil cooler 12) are provided in front of the front surfaces of the radiator 11, the oil cooler 12 and the after cooler 13. The dustproof nets 16 and 17 are dropped from above by using grooves 2*d* and 3*d*, which are provided to plates 2*c* and 3*c* extending from outer surfaces of the vertical plates 2*b* and 3*b* of the left and right frames 2 and 3, as guides, so as to be fixed to the plates 2*c* and 3*c* by wing bolts 18.

Meanwhile, the fan shroud 19 is fixed to backward surfaces of the vertical plates 2*b* and 3*b* of the left and right frames 2 and 3 by wing bolts 7. An L-shaped bracket 20 is fixed to an upper surface of the fan shroud 19 by a bolt 9*a*, and a gap between backward surfaces of the upper tanks 11*c*, 12*c* and 13*c* of the radiator 11, the oil cooler 12 and the after cooler 13 and the upper surface of the fan shroud 19 is covered with a packing (not shown). A lower portion of the fan shroud 19 is bent into L shape so as to cover a gap with the backward surfaces of the lower tanks 11*a*, 12*a* and 13*a* of the radiator 11, the oil cooler 12 and the after cooler 13 via a packing (not shown). However, as shown in FIGS. 4 and 5, the L-shaped portion is partially cut for a portion which partially faces the lower tank 11*a* of the radiator 11 and the lower tank 13*a* of the after cooler 13. A bracket 21 which coverts the cut portion is fixed to a backward surface of the fan shroud 19 by a bolt 9*b*.

Next, function and effect of the first embodiment will be explained referring to FIGS. 1 through 5.

When maintenance such as cleaning and check of the front surfaces of the radiator 11, the oil cooler 12 and the after cooler 13 is carried out, firstly the wing bolts 18 are removed, and the dustproof nets 16 and 17 are pulled out upward. As a result, the whole front surfaces of the radiator 11, the oil cooler 12 and the after cooler 13 are exposed, and sufficient space exists in front of them, thereby carrying out the maintenance easily. At the time of the maintenance such as cleaning and check of only the oil cooler 12, only the dustproof net 17 may be removed.

In addition, when the radiator 11 or the after cooler 13 is removed from the frame 1, firstly the bolts 9*a* and 9*b* are removed, and the bracket 20 and the bracket 21 are removed from the upper surface and the lower surface of the fan shroud 19. Next, the bolts 7*a* and 7*b*, which fix the upper tank 11*c* of the radiator 11 and the upper tank 13*c* of the after cooler 13 to the upper bracket 4, are removed. As a result, the radiator 11 or the after cooler 13 can be pulled up individually in a state that an outlet pipe 11*d* of the lower tank 11*a* or an outlet pipe 13*d* of the lower tank 13*a* does not interfere with the fan shroud 19, thereby removing the radiator 11 or the after cooler 13 from the frame 1 easily.

In addition, when the oil cooler 12 is removed from the frame 1, the bolt 7*c* and the bolt 9 which fix the front portion and the side portion of the oil cooler 12 to the upper and lower brackets 4 and 5 and the vertical plate 3*b* of the right frame 3 are removed, so that the oil cooler 12 can be pulled up, thereby removing the oil cooler 12 from the frame 1 easily.

In such a manner, the radiator 11, the oil cooler 12 and the after cooler 13 can be removed from the frame 1 individually without removing another cooling equipments and the fan shroud 19. For this reason, the maintenance can be carried out easily.

In addition, since the radiator 11, the oil cooler 12 and the after cooler 13 are arranged in parallel, all dirt and dust which pass through the cooling equipments remain in the fan shroud 19. Therefore, only the bracket 21 which is mounted to the lower portion of the fan shroud 19 is removed, so that the inside of the fan shroud 19 is partially opened. For this reason, the dirt and dust remaining in the fan shroud 19 can be discharged easily.

Further, since the radiator 11, the oil cooler 12 and the after cooler 13 are arranged in parallel, the ventilation passages of the cooling equipments are not overlapped. For this reason, ventilation resistances are reduced so that a ventilation amount increases, and a temperature of cooling wind passing through the cooling equipments is lowered, thereby improving the cooling efficiency.

Figure 6:
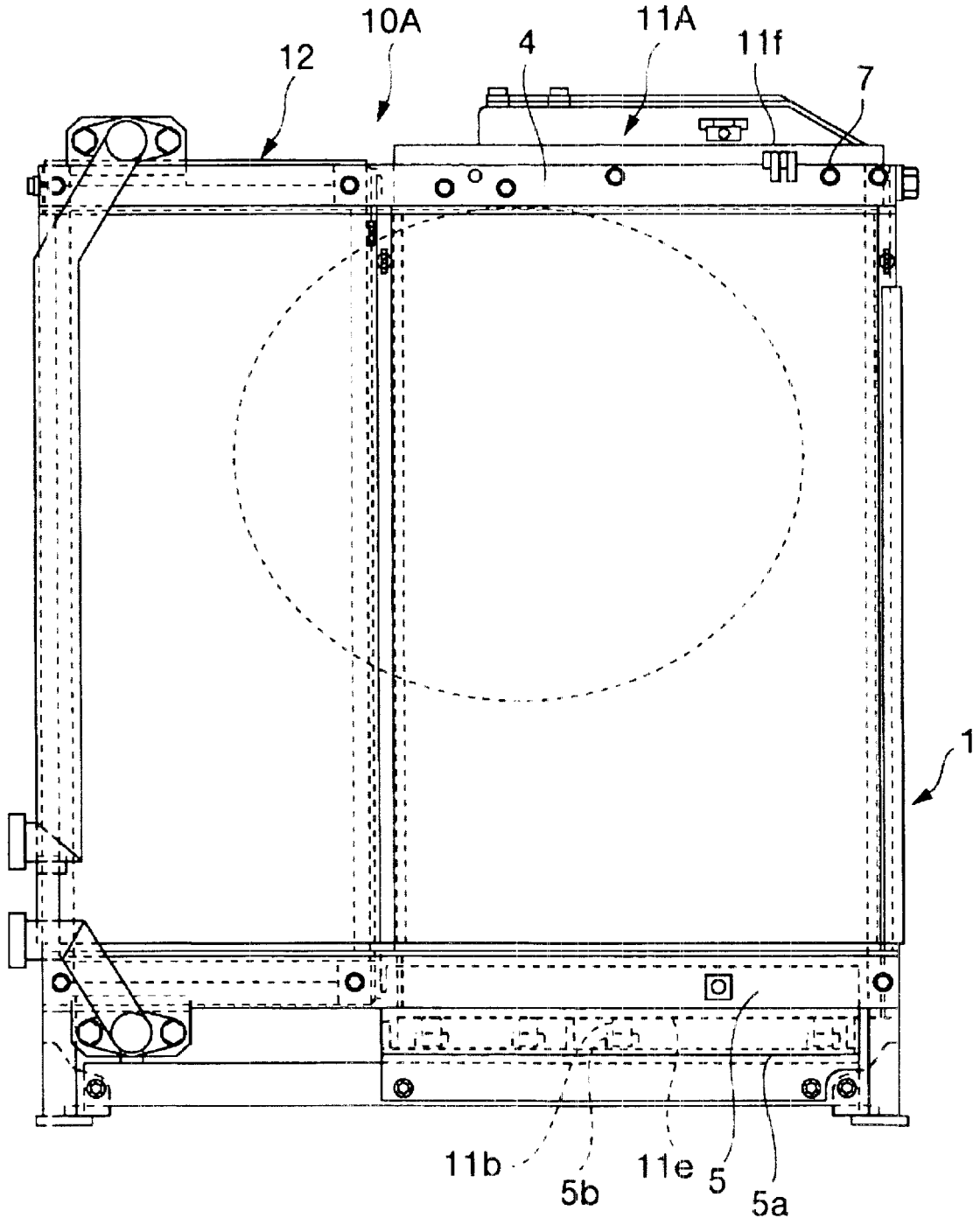
FIG. 6 is a front view of a cooling apparatus according to a second embodiment.
Figure 7:
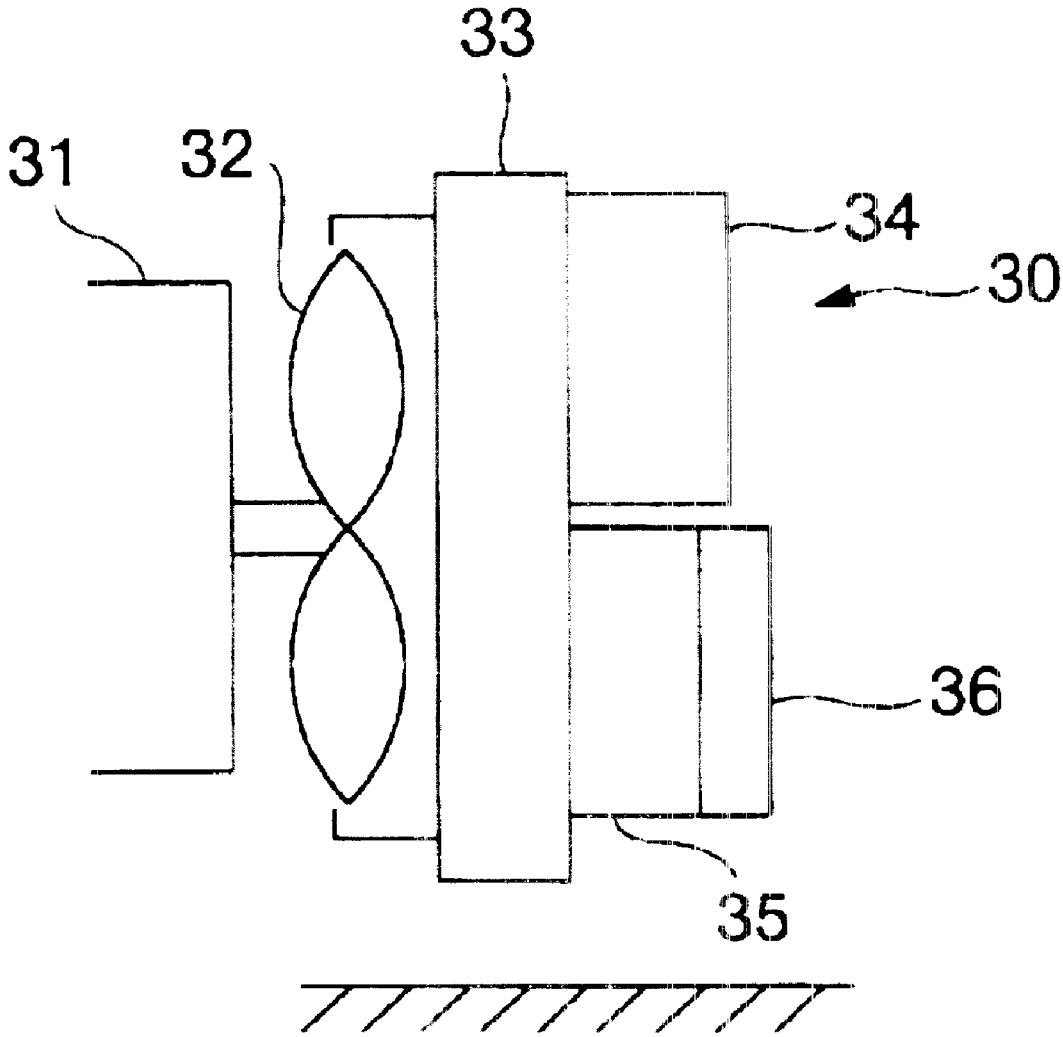
Prior Art Fig. 7
FIG. 7 is a diagram showing a first example of a conventional cooling apparatus.
Figure 8:
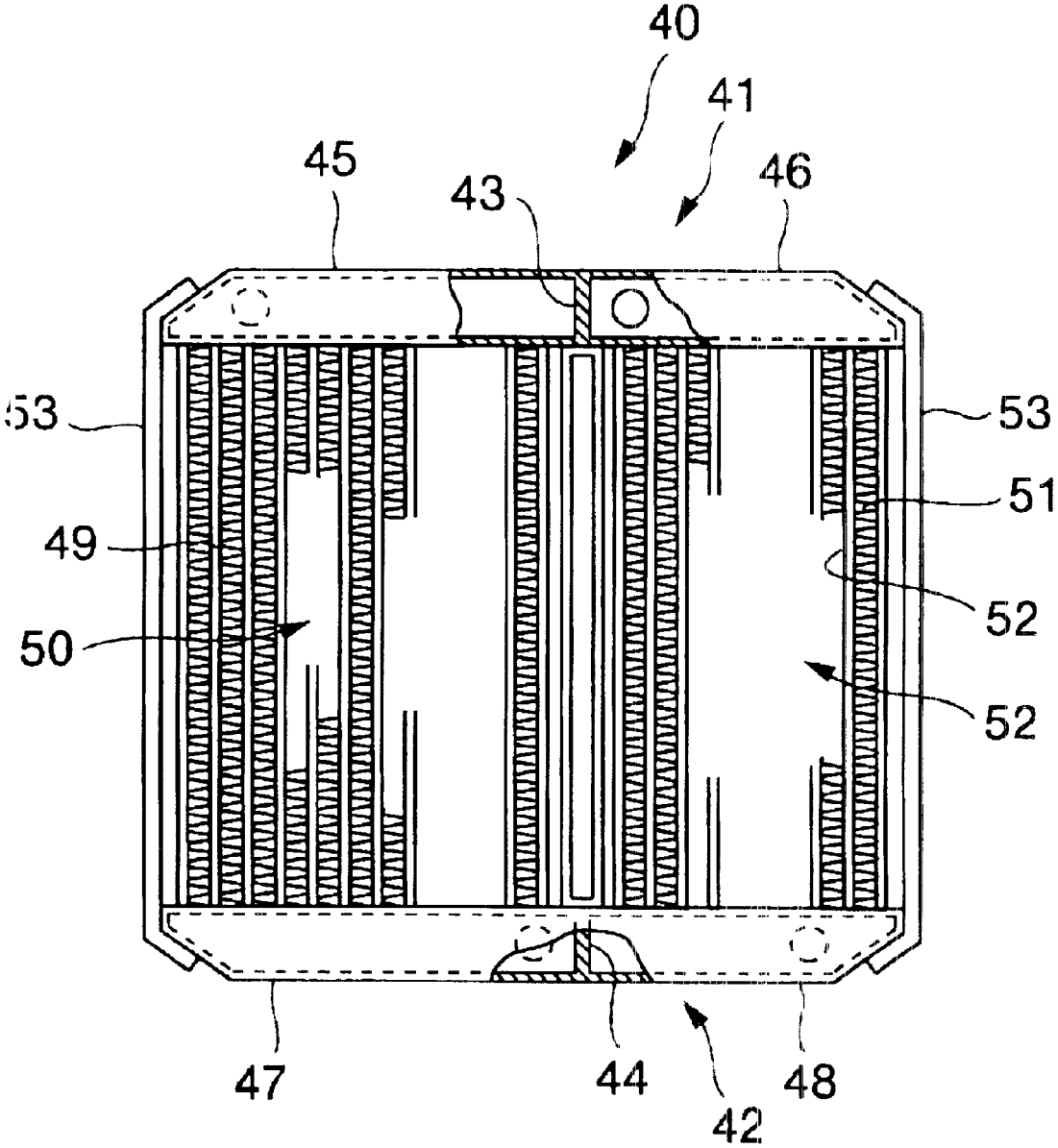
Prior Art Fig.8
FIG. 8 is a diagram showing a second example of a conventional cooling apparatus.
Figure 9:
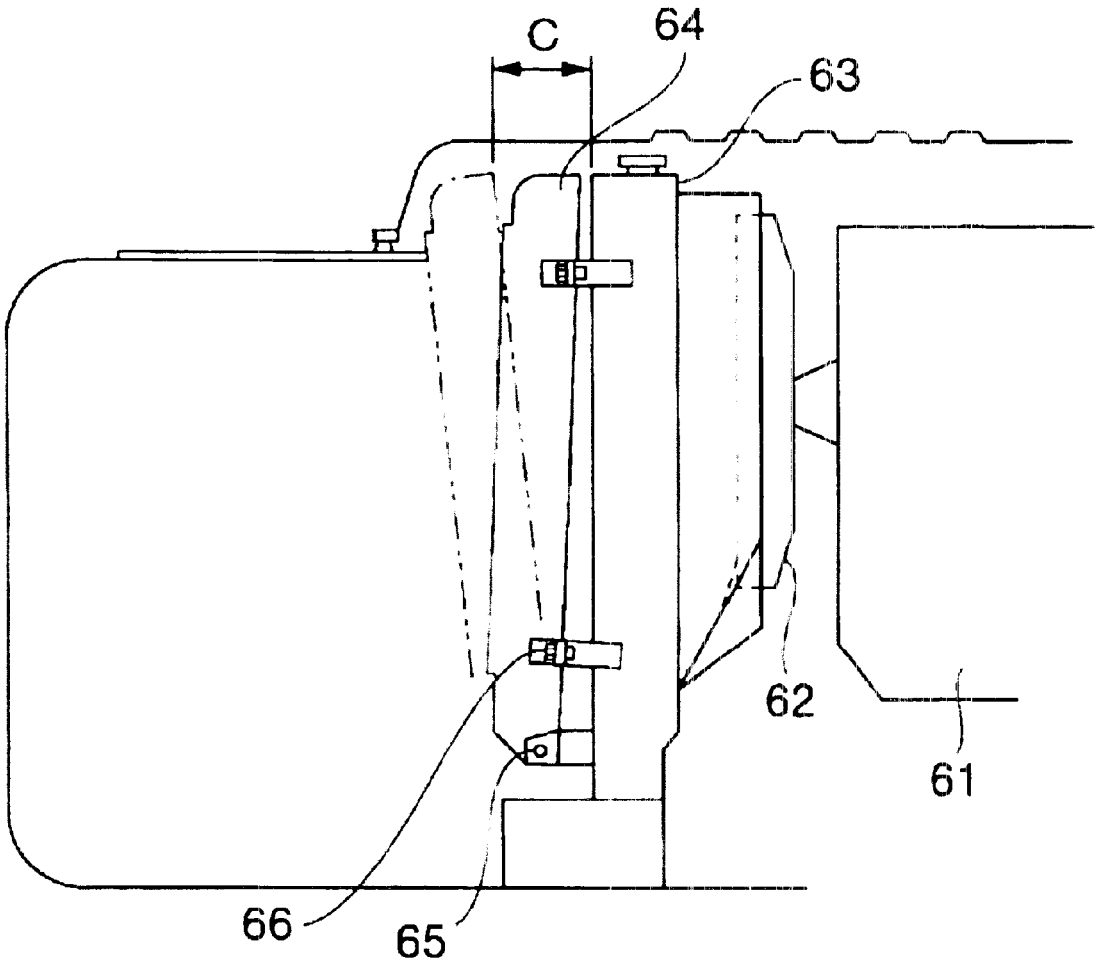
Prior Art Fig.9
FIG. 9 is a diagram showing a third example of a conventional cooling apparatus.

Next, a second embodiment will be explained referring to FIG. 6. FIG. 6 is a front view of a cooling apparatus according to the second embodiment.

In the cooling apparatus 10A of the second embodiment, the radiator 11 and the after cooler 13 in the first embodiment is eliminated, but a radiator 11A is mounted.

As shown in FIG. 6, the radiator 11A is mounted to the frame 1 in such a manner that three feet 11*b* provided on a lower surface of a lower tank 11*e* are inserted into receiving bosses 5*b* of a lower bracket 5 and an upper tank 11*f* is fixed to an upper bracket 4 by a bolt 7.

Therefore, the function and effect of the second embodiment are the same as those in the first embodiment completely, but the second embodiment is suitable for an engine which does not require an after cooler.

As explained above, the present invention produces the following effects.

A frame for forming an opening portion is provided on a ventilation passage of a fan, and a radiator and an oil cooler, or a radiator and an oil cooler and a after cooler are arranged in parallel on the opening portion of the frame. For this reason, another cooling equipment does not exist in front of the respective cooling equipments, thereby removing the cooling equipments individually without removing another cooling equipments. As a result, maintenance such as cleaning and check can be carried out easily.

In addition, since the cooling equipments are mounted so that at least one of them can be detachable individually, one of them is removed so as to be maintained easily.

Further, since a fan shroud is mounted to the frame, the cooling equipments can be mounted/detached without removing the fan shroud, thereby carrying out the maintenance easily.

Furthermore, since a part of the fan shroud is detachable, a part of the fan shroud is removed so that the cooling equipments can be attached and detached easily, and dirt and dust which remain in the fan shroud can be discharged easily.

Other aspects, objects and advantages of this invention can be obtained from a further study of the drawings, the disclosure and the appended claims.

What is claimed is:

1. A cooling apparatus of a work machine, comprising:

a ventilation passage provided on an upper stream side of a fan, a frame having an opening, the opening of the frame arranged in the ventilation passage; and a radiator and an oil cooler respectively having a front portion for receiving ventilation arranged within the opening of said frame, the front portions of the radiator and the oil cooler being arranged in common plane, and sides of radiator and the oil cooler respectively abutting each other;

wherein the radiator and oil cooler are detachably mounted to the frame, so that either of the radiator and oil cooler can be detached from the frame without detaching another of the radiator and oil cooler from the frame.

2. The cooling apparatus of a work machine as set forth in claim 1, wherein the radiator and the oil cooler are perpendicular to the ventilation passage.

3. The cooling apparatus of a work machine as set forth in claim 2, wherein a fan shroud is mounted on the frame.

4. The cooling apparatus of a work machine as set forth in claim 3, wherein a part of the fan shroud is detachable from the cooling apparatus.

5. A cooling apparatus of a work machine, comprising:

a ventilation passage provided on an upper stream side of a fan, a frame having an opening, the opening of the frame arranged in the ventilation passage; and a radiator, oil cooler and an after cooler respectively having a front portion for receiving ventilation arranged within the opening of said frame; the front portions of the radiator, oil cooler and an after cooler being arranged in common plane, and sides of radiator, oil cooler and an after cooler respectively abutting each other;

wherein the radiator, oil cooler and after cooler are detachably mounted to the frame; so that any one of the radiator, oil cooler and an after cooler can be detached from the frame without detaching another of the radiator, oil cooler and after cooler from the frame.

6. The cooling apparatus of a work machine as set forth in claim 5, wherein the radiator and the oil cooler are perpendicular to the ventilation passage.

7. The cooling apparatus of a work machine as set forth in claim 5, wherein a fan shroud is mounted on the frame.

8. The cooling apparatus of a work machine as set forth in claim 7, wherein a part of the fan shroud is detachable from the cooling apparatus.

* * * * *

UNITED STATES PATENT AND TRADEMARK OFFICE

CERTIFICATE OF CORRECTION

PATENT NO. : 6,907,916 B2
APPLICATION NO. : 10/278857
DATED : June 21, 2005
INVENTOR(S) : Hitoshi Koyama It is certified that error appears in the above-identified patent and that said Letters Patent is hereby corrected as shown below:

On the title page item "(73)" should read --Toyo Radiator Co., Ltd., Tokyo, (JP)--

Signed and Sealed this

Twenty-sixth Day of December, 2006

JON W. DUDAS
*Director of the United States Patent and Trademark Office*